US008726432B1

(12) United States Patent
Benninger

(10) Patent No.: US 8,726,432 B1
(45) Date of Patent: May 20, 2014

(54) SLEEPING BAG AND HOOD ASSEMBLY

(71) Applicant: Gary N. Benninger, West Bloomfield, MI (US)

(72) Inventor: Gary N. Benninger, West Bloomfield, MI (US)

(73) Assignee: Gary N. Benninger, West Bloomfield, MI (US)

( * ) Notice: Subject to any disclaimer, the term of this patent is extended or adjusted under 35 U.S.C. 154(b) by 0 days.

(21) Appl. No.: 13/778,300

(22) Filed: Feb. 27, 2013

(51) Int. Cl.
*A47G 9/08* (2006.01)

(52) U.S. Cl.
USPC ..... 5/413 R; 5/494

(58) Field of Classification Search
USPC ..... 5/413 R, 494, 413 AM; 2/69.5
See application file for complete search history.

(56) References Cited

U.S. PATENT DOCUMENTS 1,919,154 A * 7/1933 Astrove ..... 2/69
2,372,110 A * 3/1945 Noone ..... 2/84
5,815,833 A * 10/1998 Kuo ..... 2/69.5

* cited by examiner

*Primary Examiner* — Fredrick Conley
(74) *Attorney, Agent, or Firm* — Dickinson Wright PLLC

(57) ABSTRACT

A sleeping bag assembly having a sleeping bag and non-integral hood is constructed so as to allow the user to be able to sleep on either side, back or stomach without rotating the sleeping bag while all the time keeping a face opening of the hood in position relative to the user's face.

14 Claims, 5 Drawing Sheets

SLEEPING BAG AND HOOD ASSEMBLY

FIELD

The present disclosure relates generally to sleeping bags and, more particularly, to a cold weather sleeping bag adapted for use with a non-integral hood that seals relative to the sleeping bag while allowing the user to keep the hood's face opening in the same position relative to the user's face while permitting the user to assume sleeping positions on either side, back or stomach.

BACKGROUND

This section provides background information related to the present disclosure which is not necessarily prior art.

A sleeping bag typically includes first and second opposed halves defining a sleeping compartment therebetween and which are connected in such a way to define an entrance aperture at an entrance side or end of the sleeping bag. Each half of the sleeping bag includes an outer shell and an inner shell with an insulating material disposed and retained between these two layers. Insulation thickness depends on the minimum ambient air temperatures that are expected to be encountered by the user. Colder temperatures require a greater thickness of insulation to keep heat loss from the user sufficiently low enough that the user does not become uncomfortable. Sleeping bags come in several different physical configurations including, but not limited to, rectangular, semi-rectangular and mummy. In addition, many sleeping bags incorporate an integral hood. Typically, sleeping bags have one or more closure devices, such as zippers, of a selected length to provide access to the entrance aperture and which can be located on the sides, ends or top to permit use of the sleeping bag.

Cold weather sleeping bags normally incorporate integral hoods to minimize drafts and provide more insulation than is normally afforded using commonly available head covers. Often these cold weather bags also incorporate internal collars with draw cords that allow the collars to be snugged around the user's neck to further reduce drafts while also dividing the sleeping compartment into two distinct volumes, one for the body and one for the head. Since the hood is integral, the face opening is designed to be in a predetermined or "set" position relative to the user's face and mouth which is typically defined when the user is lying on his/her back. If the user wishes to sleep on their side or stomach they must turn the bag to retain the hood face opening in the proper position relative to the face. Thus, it is difficult to change positions while retaining the face opening in the set position relative user's face since the whole sleeping bag must be rotated. This is especially difficult in the confines of a small tent, as would normally be used in conjunction with such cold weather sleeping bags in mountaineering or backpacking applications. On the other hand, if the user rotates in the bag, which is a much simpler and easier proposition than rotating the whole bag, they will then be breathing into the interior of the bag with the face opening of the bag now at the side or back of their head. Breathing inside the bag is an unacceptable condition since it introduces significant amounts of moisture into the inside of the bag which, as it passes through the insulation, driven by the thermal gradient and air motion, condenses in the insulation, thus reducing the effectiveness of the insulation.

SUMMARY

The following presents a simplified summary of some embodiments of the present disclosure in order to provide a basic understanding of the inventive concepts. This summary is not an extensive overview of the present disclosure. Furthermore, this summary is not intended to identify key/critical elements of the invention and/or delineate the scope of the claimed subject matter. Accordingly, the primary purpose of this summary is to present some embodiments and/or features of the present disclosure in a simplified form as a prelude to the more detailed description presented later in this application.

It is an aspect of the present teachings to provide a sleeping bag that overcomes the undesirable features of prior art sleeping bags.

It is another aspect of the present disclosure to provide a two-piece sleeping bag assembly comprised of a sleeping bag having a neck aperture and an independent hood adapted to be installed over the user's head and having a hood face opening that is sized to be located relative to the user's face. An elongated neck portion of the hood is sealed relative to the neck aperture of the sleeping bag while allowing independent movement of the hood relative to the sleeping bag.

It is yet another aspect of the present disclosure to provide adjustment features in association with the neck aperture of the sleeping bag to facilitate adjustment of the size of the neck aperture to optimize the thermal, compressible seal established with the neck portion of the hood.

In accordance with these and other aspects, the present disclosure is directed to cold weather sleeping bag assembly comprised of a sleeping bag and a non-integrated hood. The sleeping bag constructed with a fixed or adjustable neck aperture which accepts and provides an interference seal around the long necked insulated hood. The hood may or may not be constructed to specifically mate with the cold weather sleeping bag. Separating the insulated hood from the insulated sleeping bag while maintaining a thermal, compressible seal therebetween allows the hood to rotate independently of the sleeping bag which, in-turn, allows the user to assume any sleeping position while retaining the hood face opening (whose area is normally adjustable by a draw cord) relative to the user's face.

Further areas of applicability will become apparent from the description and claims herein. The description and specific examples in the disclosure and summary are intended for purposes of illustration only and are not intended to limit the scope of the present invention.

DRAWINGS

The drawings described herein are for illustrative purposes only of selected exemplary embodiments and are not intended to limit the scope of the present disclosure in any way. Similar or identical elements are given consistent reference numerals throughout the various figures.

Reference now will be made to the accompanying drawings in which.

DETAILED DESCRIPTION

The following exemplary embodiments are provided so that the present disclosure will be thorough and fully convey the scope to those skilled in the art. Numerous specific details are set forth such as examples of specific components, devices and schematic configurations to provide a thorough understanding of exemplary embodiments of the present disclosure. However, it will be apparent to those skilled in the art that these specific details need not be employed, that the exemplary embodiments may be embodied in many different forms, and that neither should be construed to limit the scope of the present disclosure.

Figure 1:
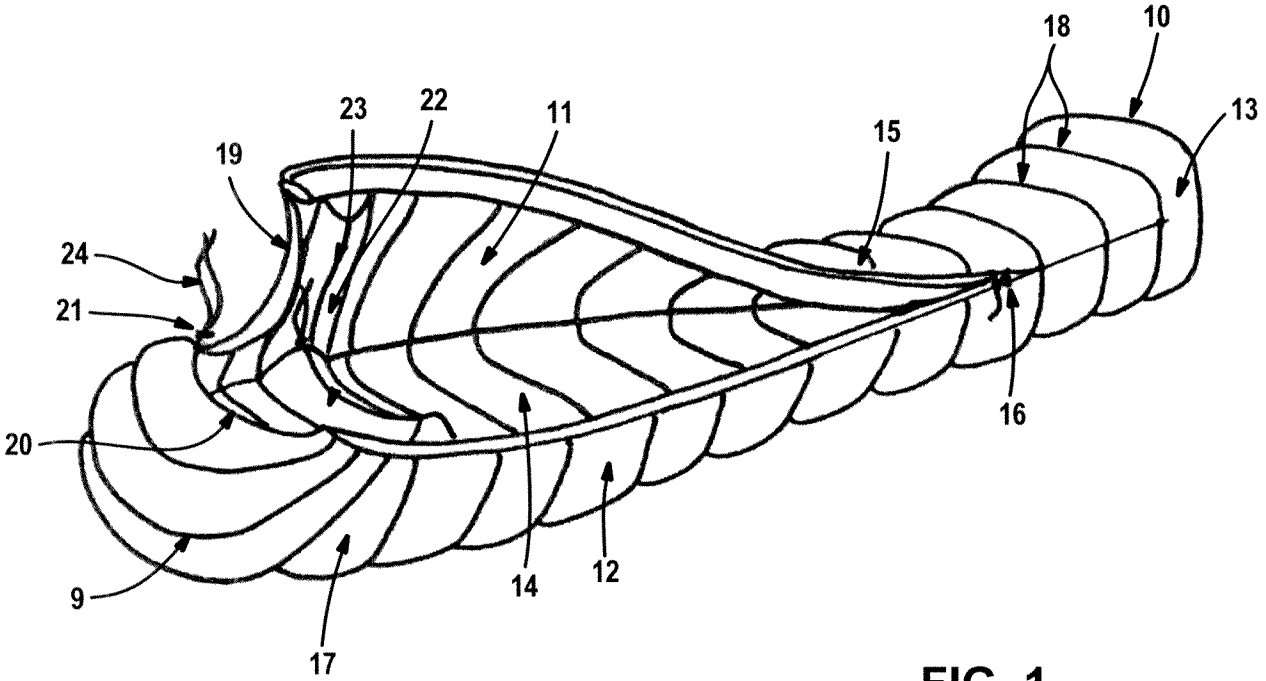
FIG. 1 Prior Art
FIG. 1 shows a perspective an exemplary view of a conventional, cold weather side-zippered sleeping bag equipped with an integral-hood.

Referring to FIG. 1, a perspective view of a conventional cold-weather sleeping bag 10 having an integral hood 9 is shown in a partially open position and may be constructed to have an entrance end 11. The entrance end 11 corresponds to the end of sleeping bag 10 which is intended to receive a user's head and upper body while a lower end 13 corresponds to the end of sleeping bag 10 intended to receive a user's legs and feet. The sleeping bag 10 is generally shown to include an outer shell 12, an inner shell 14 and a closure device, such as a zipper assembly 16. Some specialized insulating material 18 having a low coefficient of thermal conductivity and good compressibility may be inserted and retained between the outer shell 12 and the inner shell 14. As is conventional, light-weight fabrics, such as nylon and polyester, are used for the exterior surfaces defined by outer shell 12 and the interior surfaces defined by inner shell 14.

The sleeping bag 10 has a first half 15 and a second half 17 arranged in opposing facing relation so that first half 15 and second half 17 are configured to define a sleeping compartment therebetween when zipper assembly 16 is closed. A drawstring 24 can be used in conjunction with a pair of draw hems 19 and 20 to adjustably vary a face opening associated with hood 9 at the top of sleeping bag 10 once zipper assembly 16 has been drawn to its closed position. A drawstring lock 21 is also provided to maintain the drawstring 24 in a preferred cinched position. Cold weather bags, especially those to be used in temperatures below zero degrees Fahrenheit, may also incorporate upper and lower internal collars 22 and a corresponding draw-cord 23 to seal around the user's neck, thus creating two separate compartments within the sleeping bag, one for the user's head and one for the remainder of the user's body.

Figure 2A:
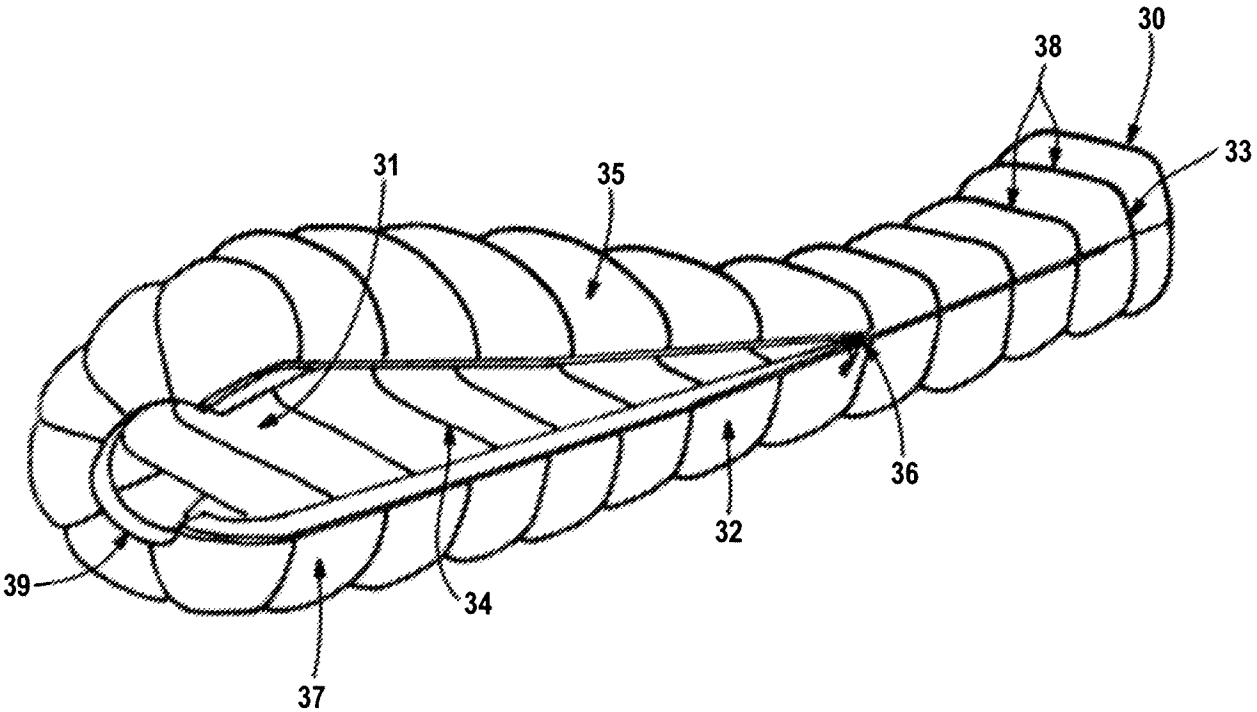
FIG. 2A shows a perspective view of an exemplary, cold weather, side-zippered, sleeping bag constructed in accordance with the present teachings.
Figure 3:
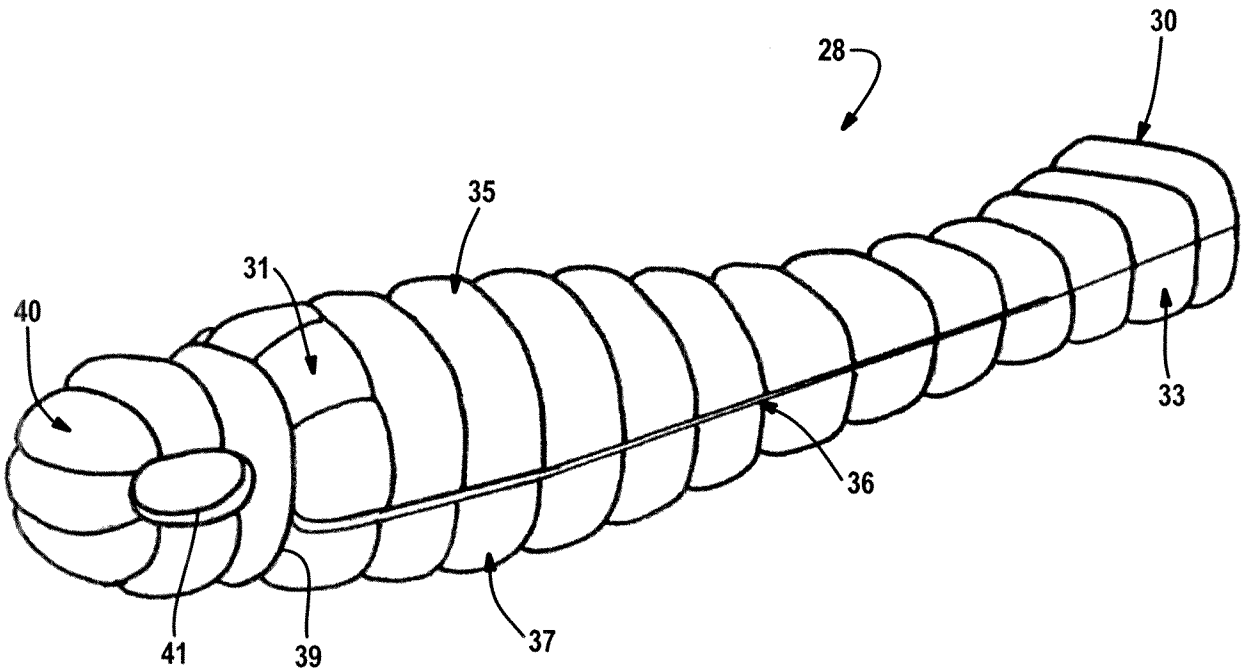
FIG. 3 shows a perspective view of the sleeping bag of FIG. 2A mated with the full-length, non-integral hood of FIG. 2B to provide a two-piece sleeping bag assembly constructed in accordance with the present teachings.

In accordance with the present disclosure, a sleeping bag assembly 28, as best shown in FIG. 3, will be described to include a sleeping bag and a non-integrated hood. Referring initially to FIG. 2A, a perspective view of an exemplary embodiment of a sleeping bag 30, constructed in accordance with the present teachings for use with sleeping bag assembly 28, is shown in a partially open position and may be constructed to have an entrance end 31. The entrance end 31 corresponds to the end of sleeping bag 30 which is intended to receive a user's upper body while a lower end 33 corresponds to the end of sleeping bag 30 intended to receive a user's legs and feet. The sleeping bag 30 is generally shown to include an outer shell 32, an inner shell 34 and a closure device, such as a zipper assembly 36. Some specialized insulating material having a low coefficient of thermal conductivity and good compressibility may be inserted and retained between the outer shell 32 and the inner shell 34. As is known, distinct tubes or sections are defined between the inner shell 34 and the outer shell 32 by baffles or separators 38. As is conventional, light-weight fabrics, such as nylon and polyester, are used for the exterior surfaces defined by outer shell 32 and the interior surfaces defined by inner shell 34.

The sleeping bag 30 has a first half or section 35 and a second half or section 37 arranged in opposing facing relation so that the first section 35 and the second section 37 are configured to define a sleeping compartment therebetween when zipper assembly 36 is closed. Although the configuration of the sleeping bag 30 utilizes a fold-over construction with connection by zipper assembly 36, many other configurations may be utilized. For example, the sleeping bag may be formed such that a connection is made at the top or bottom of the sleeping bag instead of along a side edge. Furthermore, the first and second sections may define top and bottom sections that are formed as two distinct sub-assemblies and then connected along their edges. Finally, the sleeping bag 30 may have any shaped configuration including, without limitation, rectangular or mummy shaped.

Figure 2B:
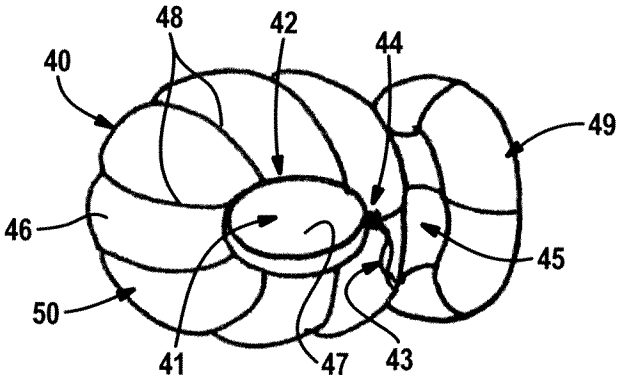
FIG. 2B shows a perspective view of a full-length, non-integral, sleeping bag hood constructed in accordance with the present teachings.

Regardless of the configuration, the sleeping bag 30 will include a neck opening 39 that is located at the entrance end 31 of the sleeping bag 30. This opening 39 may be designed having a geometric shape similar to a cross section of the user's neck but having a circumference somewhat larger than that of the user's neck in order to accommodate an overlapping seal with the hood unit. An exemplary version of a full-length, non-integral sleeping bag hood 40 is shown in FIG. 2B. If desired, the neck opening 39 may incorporate a draw hem and a locking draw cord to allow some measure of adjustability of the circumference of the neck opening 39.

As noted, FIG. 2B shows the full-length, non-integral sleeping bag hood 40 that is adapted for use in conjunction with the sleeping bag 30, both being made in accordance with the present teachings. The non-integral hood 40 may be constructed so that it opens or separates under the face opening 41 to allow it to be put in place on the user's head. In the alternative, the hood 40 may be of such proportions that it fits over the user's head without separating below the face opening 41, the latter being the warmest configuration. The hood 40 incorporates a draw hem 42 and draw cord 43 with a cord lock 44 that can be used to regulate the size of the face opening 41 in the hood 40. The draw hem, draw cord and cord lock may be installed in one of various configurations so as to allow the face opening 41 in the hood 40 to be adjusted from either or both the inside or outside of the sleeping bag 30 or the hood 40. The circumference of the neck area 45 of the hood 40 must be greater than the circumference of the neck opening 39 in order to ensure a rotary interference fit and eliminate any potential for drafts.

In accordance with a preferred construction, hood 40 includes an outer shell 46 and an inner shell 47 having an insulating material inserted therebetween and retained therein between distinct tubes or sections defined by baffles 48. Hood 40 is further shown to include a collar section 49 and a head section 50 interconnected by the neck section 45. As noted, the neck section 45 is sized for installation within the neck opening 39 of the sleeping bag 30. Collar section 49 is configured to provide additional sealing as it contacts against portions of the inner shell 34 adjacent to neck opening 39.

Referring to FIG. 3, a perspective view of an exemplary sleeping bag assembly 28 comprised of sleeping bag 30 and non-integral hood 40 constructed in accordance with the present teachings is shown in a closed position with the non-integral hood 40 shown in such a position as would occur when the user would be lying on their side.

Figure 4:
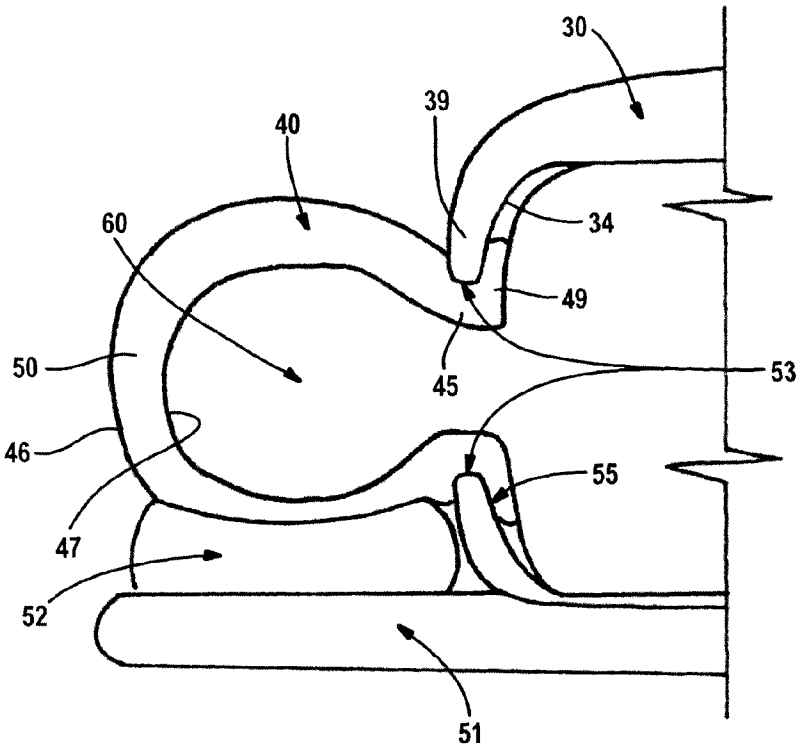
FIG. 4 shows a cross-section of the rotary interference seal area between an upper portion of the cold weather sleeping bag and a neck portion of the non-integral hood.

FIG. 4 shows a section through the sleeping bag 30, the hood 40 and the user 60 who is lying on their side on an insulating pad 51 and a pillow 52. The sectional view is taken through the head, neck and upper thoracic zones of the user 60 and clearly shows the rotary-type, radial interference seal 53 between the bag 30 and the hood 40. The radial interference seal 53 is the result of the circumference of hood 40 in the neck area 43 being greater than the circumference of the neck opening 39 in bag 40. This view also shows the rotating circumferential interference seal 55 between collar section 49 of the hood 40 and portions of inner shell 34 of the sleeping bag 30 surrounding the neck aperture 39. This combination radial and circumferential sealing interface permits the user 60 to rotate his/her body and/or head with respect to the sleeping bag 30 while maintaining a thermally sealed relationship between the hood 40 and the sleeping bag 30.

While specific aspects have been described in the specification and illustrated in the drawings, it will be understood by those skilled in the art that various changes can be made and equivalents can be substituted for elements and components thereof without departing from the scope of the present teachings, as defined in the claims. Furthermore, the mixing and matching of features, elements, components and/or functions between various aspects of the present teachings are expressly contemplated herein so that one skilled in the art will appreciate from the present teachings that features, elements, components and/or functions of one aspect of the present teachings can be incorporated into another aspect, as appropriate, unless described otherwise above. Moreover, many modifications may be made to adapt a particular situation, configuration, or material to the present teachings without departing from the essential scope thereof. Therefore, it is intended that the present teachings not be limited to the particular aspects illustrated by the drawings and described in the specification as the best mode presently contemplated for carrying out the present teachings, but that the scope of the present teachings include many aspects and examples following within the foregoing description and the appended claims.

What is claimed is:

1. A sleeping bag assembly, comprising:

a sleeping bag extending from a lower end to an entrance end and including first and second sections each having an inner layer arranged in an opposing facing relationship to define a sleeping compartment therebetween;

said sleeping bag defining a neck opening having a neck opening circumference about the entrance end of the sleeping bag;

a hood including a head portion defining a face opening, a neck portion, and a collar portion;

the neck portion of the hood having a neck portion circumference being greater than the neck opening circumference of the sleeping bag to establish a radial sealed interface fit between the hood and the neck opening of the sleeping bag when the neck portion of the hood is disposed within the neck opening of the sleeping bag; and the collar portion of the hood having a collar portion circumference being greater than the neck portion circumference for abutting the inner layer of the first and second sections adjacent the neck opening with the collar portion of the hood when the neck portion of the hood is disposed within the neck opening of the sleeping back to establish a circumferential sealed interface fit between the hood and a portion of the inner layers of the sleeping bag.

2. The sleeping bag assembly of claim 1 wherein the sleeping bag includes a closure device for selectively opening and closing the sleeping compartment.

3. The sleeping bag assembly of claim 2 wherein the head portion of the hood is adapted to be installed on a user's head such that the user's face is aligned with the face opening, and wherein the user's body is adapted to be located in the sleeping compartment of the sleeping bag such that closure of the closure device encapsulates the user's body therein, and wherein the neck portion of the hood surrounds a neck of the user and is located within the neck opening of the sleeping bag upon closure of the sleeping compartment.

4. The sleeping bag assembly of claim 3 wherein a combination of the radial sealed interface fit and the circumferential sealed interference fit permits the user's head to move independently of the sleeping bag while maintaining alignment of the user's face with the face opening in the hood.

5. The sleeping bag assembly of claim 2 wherein the closure device is a zipper assembly.

6. The sleeping bag assembly of claim 1 wherein the hood further includes an adjustment mechanism for selectively adjusting the size of the face opening.

7. The sleeping bag assembly of claim 1 wherein the hood includes a separation extending from the face opening to the collar portion and an attachment mechanism for closing the separation to define a closed hood.

8. The sleeping bag assembly of claim 1 wherein the sleeping bag and the hood are made from the same materials.

9. The sleeping bag assembly of claim 1, wherein the sleeping bag further includes an adjustment mechanism for selectively adjusting the size of the neck opening.

10. A sleeping bag assembly, comprising:

a sleeping bag defining a neck opening;

an independent hood for placement over a user's head;

said independent hood defining a hood face opening for alignment relative to a user's face when said independent hood is placed over the user's head; and said independent hood including a neck portion configured to establish a rotary interference fit with said neck opening of said sleeping bag for allowing independent and sealed rotatable movement of said independent hood relative to said sleeping bag to permit the user's face to maintain alignment with said hood face opening of said independent hood when the user's head moves relative to said sleeping bag.

11. The sleeping bag assembly of claim 10, wherein said independent hood further includes an adjustment mechanism for selectively adjusting a size of said hood face opening.

12. The sleeping bag assembly of claim 10, wherein said sleeping bag further includes an adjustment mechanism for selectively adjusting a size of said neck opening.

13. The sleeping bag assembly of claim 10, wherein said sleeping bag further includes first and second sections arranged in an opposing facing relationship to define a sleeping compartment therebetween and a closure device for selectively opening and closing said sleeping compartment.

14. The sleeping bag assembly of claim 13, wherein said closure device is a zipper assembly.

* * * * *